US007777738B2

(12) United States Patent
Hoppenbrouwers et al.

(10) Patent No.: US 7,777,738 B2
(45) Date of Patent: Aug. 17, 2010

(54) ACTIVE MATRIX DISPLAY WITH REDUCTION OF POWER CONSUMPTION

(75) Inventors: Jurgen Jean Louis Hoppenbrouwers, Eindhoven (NL); Roel Van Woudenberg, Eindhoven (NL); Fransiscus Jacobus Vossen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 736 days.

(21) Appl. No.: 10/598,581

(22) PCT Filed: Mar. 4, 2005

(86) PCT No.: PCT/IB2005/050808

§ 371 (c)(1),
(2), (4) Date: Sep. 5, 2006

(87) PCT Pub. No.: WO2005/088593

PCT Pub. Date: Sep. 22, 2005

(65) Prior Publication Data

US 2007/0182672 A1 Aug. 9, 2007

(30) Foreign Application Priority Data

Mar. 10, 2004 (EP) ..... 04100965

(51) Int. Cl.
*G09G 3/36* (2006.01)

(52) U.S. Cl. ..... 345/211; 345/212

(58) Field of Classification Search ..... 345/82, 345/211, 212, 58, 87
See application file for complete search history.

(56) References Cited

U.S. PATENT DOCUMENTS 5,526,335 A 6/1996 Tamegai (Continued)

FOREIGN PATENT DOCUMENTS

EP 0464811 B1 10/1997

(Continued)

OTHER PUBLICATIONS

D. Fish et al, "A Comparison of Pixel Circuits for Active Matrix Polymer/Organic LED Displays", SID 02 Digest, pp. 968-971.

*Primary Examiner*—Amare Mengistu
*Assistant Examiner*—Koosha Sharifi

(57) ABSTRACT

An active matrix display comprises a select driver (SD) to drive select electrodes (SE), and a data driver (DD) to supply data (D) to data electrodes (DE). Pixels (10) are associated with intersections of the data electrodes (DE) and the select electrodes (SE). The pixels (10) comprise a light emitting element (L) and a pixel driving circuit (PD). The pixel driving circuit (PD) receives a power supply voltage (VB) via a power supply electrode (PE), and data (D) via a data electrode (DE) to control a brightness of the light emitting element (L). A power supply (PS) supplies the power supply voltage (VB). The power supply electrodes (PE) are arranged to supply the power supply voltage (VB) to the pixel driving circuits (PD) of lines of pixels (10) extending in the same direction as the select electrodes (SE) or in the same direction as the data electrodes (DE). The load (AL; MA; IL) on the power supply electrodes (PE) caused by the pixels (10) associated with the lines of pixels (10) is determined (LL), and the level of the power supply voltage (VB) is controlled (CO) dependent on the load (AL; MA; IL).

13 Claims, 3 Drawing Sheets

U.S. PATENT DOCUMENTS

| | | | | |
|---|---|---|---|---|
| 5,541,903 | A | 7/1996 | Fanahashi et al. | |
| 5,684,368 | A | 11/1997 | Wei et al. | |
| 5,848,438 | A | 12/1998 | Nemazie et al. | |
| 5,956,309 | A | 9/1999 | Yamamuro | |
| 6,249,884 | B1 | 6/2001 | Joo | |
| 6,734,636 | B2 * | 5/2004 | Sanford et al. | 315/169.3 |
| 2002/0108072 | A1 | 8/2002 | Beng Sim et al. | |
| 2003/0011314 | A1 * | 1/2003 | Numao | 315/169.3 |
| 2003/0112231 | A1 * | 6/2003 | Kurumisawa | 345/212 |
| 2003/0122496 | A1 | 7/2003 | Lee et al. | |
| 2003/0122759 | A1 * | 7/2003 | Abe et al. | 345/89 |
| 2004/0004591 | A1 * | 1/2004 | Akimoto et al. | 345/84 |
| 2005/0017922 | A1 * | 1/2005 | Devos et al. | 345/6 |
| 2006/0001613 | A1 * | 1/2006 | Routley et al. | 345/76 |

FOREIGN PATENT DOCUMENTS

| | | | |
|---|---|---|---|
| EP | 0971349 | A2 | 6/1999 |
| EP | 0965988 | A2 | 12/1999 |
| JP | 10092149 | A | 4/1998 |
| WO | 0122416 | A1 | 3/2001 |

* cited by examiner

ACTIVE MATRIX DISPLAY WITH REDUCTION OF POWER CONSUMPTION

FIELD OF THE INVENTION

The invention relates to an active matrix display, a controller for an active matrix display, and a method of controlling an active matrix display.

BACKGROUND OF THE INVENTION

An active matrix light emitting device (further referred to as LED) display comprises an array of pixels. Each pixel comprises a pixel driving circuit and a LED. The pixel driving circuit receives an address select signal or a set of address select signals via select electrode(s), a data signal via a data electrode, and a power supply voltage via a power supply electrode to supply a voltage generating a current through the LED. Usually, the pixels are arranged in a matrix comprising columns and rows. In this matrix arrangement, usually, the pixels are selected row by row via the select electrodes extending in the row direction and the data is supplied to the selected pixels via the data electrodes extending in the column direction. The power supply electrodes may extend in the row direction or in the column direction. The grey level of a pixel is determined by the level of the voltage on the data electrode. It is possible to use more than one select electrode to drive the pixel circuit, for example, to control the duty cycle of the light generation. The LED's are current-driven devices of which the luminance is determined by the current that flows through it.

If a particular one of the select electrodes has a voltage indicating to the associated row of pixel driving circuits that the associated row of LED's should be selected, the associated row of pixel driving circuits are programmed by the data signals to supply respective currents to the LED's of the selected row to generate an amount of light corresponding to the value of the respective data signal received via the data electrodes. When a next row of pixels is selected, the state of the previous row of pixels is frozen.

The power supply electrodes supply the current which is required by the LED's to generate light. Thus, if the power supply electrodes extend in the column direction, the current in a particular power supply electrode depends on the state of the pixels in the associated column. If the power supply electrodes extend in the row direction, the current in a particular power supply electrode depends on the state of the pixels in the associated row. Because the power supply electrode has a resistance and current is flowing through it to the pixels, a voltage drop will occur across it which can result in cross-talk. The power supply voltage supplied to each pixel of the display should at least be sufficient for the pixel driving circuit to supply a voltage to the LED to obtain the required current through it. The power supply which supplies the power supply voltage to the power supply electrodes has to be selected sufficiently high to take care of the largest voltage drop possible across the power supply electrode. Consequently, the power consumption of the display will be, on average, much larger than required. This will especially be a problem for large size displays wherein the power supply electrode is relatively long, has a relatively high resistance, and has to supply a high current due to a large amount of LED's which is associated with the power supply electrode.

SUMMARY OF THE INVENTION

It is an object of the invention to reduce the power consumption of the matrix display.

A first aspect of the invention provides an active matrix display as claimed in claim 1. A second aspect of the invention provides a controller for an active matrix display as claimed in claim 13. A third aspect of the invention provides a method of controlling an active matrix display as claimed in claim 14. Advantageous embodiments are defined in the dependent claims.

An active matrix display in accordance with the first aspect of the invention comprises a select driver for driving select electrodes and a data driver for supplying data to data electrodes intersecting the select electrodes. For example, the select electrodes extend in the row direction and the data electrodes extend in the column direction. Alternatively, the select electrodes may extend in the column direction and the data electrodes may extend in the row direction. The pixels are associated with the intersections of the data electrodes and the select electrodes. Each pixel comprises a LED and a pixel driving circuit. The pixel driving circuits associated with a selected one of the select electrodes control the associated LED's to emit an amount of light indicated by the data on the data electrodes. Thus, the pixel driving circuits receive a select voltage via the select electrodes, a data signal via the data electrodes, and a power supply voltage via the power supply voltage electrodes. A power supply supplies the power supply voltage to the power supply electrodes. The power supply electrodes may extend in the same direction as the select electrodes or in the same direction of the data electrodes. Thus, the lines of pixels associated with one of the power supply electrodes extend in the same direction as the select electrodes or in the same direction as the data electrodes.

A level of the power supply voltage is controlled by a load on the power supply caused by the pixels associated with the lines of pixel driving circuits. The power supply voltage is controlled to have a level which varies with the load to guarantee a correct operation of the pixel driving circuits. Consequently, the level of the power supply voltage is always sufficient high because the maximum voltage drop which occurs across the power supply electrodes and which is determined by the load is taken into account. On the other hand, the level of the power supply voltage need not have a relative high fixed value which is required for the worst case situation wherein the maximum load occurs. The level of the power supply voltage now varies with the actually occurring highest load. Usually, the worst case situation occurs when all LED's have to generate the maximum amount of light. By determining the load and controlling the power supply voltage accordingly, the power supply voltage depends on the average image content displayed and the average power consumption decreases.

Preferably, the load is determined for the lines of pixels associated with every power supply electrode separately. The maximum load occurring on the line of pixels of a group of lines of pixels to which the same power supply voltage is supplied determines the level of this power supply voltage.

U.S. Pat. No. 5,684,368 discloses an array of light emitting devices (further referred to as LED's) arranged in an array of columns and rows of pixels, each pixel has an associated resistance and current requirement. A driver includes a plurality of column drivers and a plurality of row drivers coupled to the columns via column conductors and to the rows via row conductors, respectively. The array forms a passive matrix display because the LED's are connected directly between the column conductors and the row conductors. Further, the array is selected row by row and the pixels of the selected row only generate light during the period in time this row is selected. The lumped resistor in series with each LED represents the resistance of the associated column conductor, the associated row conductor and the associated LED.

A controllable power supply has a first terminal coupled to the column driver, a second terminal coupled to the row driver, and a control terminal connected to control a power supply voltage applied between the first and the second terminal in response to a control signal. Due to the current drawn by the LED and the resistor in series with the LED, a voltage difference occurs between the first and the second LED of a column if the same current has to flow into these LED's. A control circuit senses the voltage drop across each one of the resistors associated with each one of the LED's and controls the power supply to compensate for this voltage drop. This is possible for each selected row of pixels because only these pixels may conduct current. However, in fact, the drive voltage over the pixel is directly varied. This has the drawback that the compensation of the voltage drop has an influence on the voltage drop and thus causes a recursive effect which is difficult to handle.

The present invention differs from the prior art in that it is not the voltage supplied across the LED's which is varied but the power supply voltage of the pixel drive circuits. The current supplied to the LED's is determined by the data supplied to the pixel drive circuits and should be independent of the power supply voltage. On the one hand, the power supply voltage is varied such that it is always sufficiently large to guarantee a correct operation of the pixel drive circuits. On the other hand, the power supply voltage is preferably as low as possible to minimize the power consumption of the active matrix display. The pixel driving circuits in accordance with the present invention are not present in the prior art. It has to be noted that all the pixels in the same column may generate light at the same time, depending on the data. It is thus not possible to correct the power supply voltage of the pixels separately per row as in the prior art.

In an embodiment as claimed in claim 2, the level of the power supply voltage is increased if the level of the load increases. An increase of the load indicates that the number of LED's which generate light increases. The voltage drop across the power supply electrodes will become larger and the power supply voltage has to be increased to maintain the correct operation of the pixel driving circuits.

In an embodiment as claimed in claim 3, the load of the pixels associated with the lines of pixel driving circuits is defined as the ratio between the summed grey level of the pixels generating light and the maximum grey level of the pixels multiplied by the total number of pixels of the line of pixels. This ratio can be easily calculated from the data.

In an embodiment as claimed in claim 4, the power supply electrodes extend in the direction of the data electrodes. The same power supply voltage is supplied to all power supply electrodes. The load is determined for each one of the power supply electrodes separately. The highest one of the loads determines the required level of the power supply voltage. In this manner, only a single controllable power supply is required. The power supply voltage generated by this power supply is controlled such that the power supply electrode which is loaded heaviest receives a power supply voltage sufficient to allow a correct operation of the associated pixel driving circuits. For the other power supply electrodes, the power supply voltage is larger than required, but still, on average, the power consumption is lower than if the power supply voltage has a fixed value suitable to cover the worst case situation wherein all LED's associated with a power supply electrode have to generate light.

In an embodiment as claimed in claim 5, the power supply electrodes extend in the direction of the select electrodes. The same power supply voltage is supplied to all power supply electrodes. The load is determined for each one of the power supply electrodes separately. The power supply voltage is controlled to a level suitable for the highest one of the loads determined. Again, in this manner only a single controllable power supply is required. The power supply voltage generated by the power supply is controlled such that the power supply electrode which is loaded heaviest receives a power supply voltage sufficient to allow a correct operation of the associated pixel driving circuits. For the other power supply electrodes, the power supply voltage is larger than required. But still, on average, the power consumption is lower than if the power supply voltage has a fixed value suitable to cover the worst case situation wherein all LED's associated with a power supply electrode have to generate light.

In an embodiment as claimed in claim 6, the power supply supplies a plurality of power supply voltages to an associated plurality of groups of the power supply electrodes. Thus, the power supply electrodes are divided in groups which each receive their own power supply voltage. The groups may comprise the same or a different amount of power supply electrodes. The groups may comprise a single power supply electrode, or several power supply electrodes. The load is determined for each one of the plurality of power supply voltages, and a level of each one of the power supply voltages is controlled in dependence on the associated load determined. Thus, the power supply voltage of each group can be optimized such that depending on the load for this group, the pixel driving circuits of this group operate correctly and the power consumption is minimal.

In an embodiment as claimed in claim 7, the pixels of the same color are grouped together to receive the same power supply voltage. In a preferred embodiment, the groups are made per primary color, thus one group covering all red subpixels, a second group covering all green subpixels, and a third group covering all blue subpixels. If the matrix display has also white pixels, also these white pixels are gathered in a group which receives its own power supply voltage.

In an embodiment as claimed in claim 8, the load on each one of the power supply electrodes of at least one of the groups is determined to find the highest one of the loads. The power supply voltage associated with this at least one of the groups is controlled to a level suitable for the highest one of the loads determined within said at least one of the groups. Preferably, the highest load is determined for each group.

In an embodiment as claimed in claim 9, further an average image load, which is determined by all the pixels of the active matrix display, is determined. The level of the power supply voltage depends both on the load of the pixels associated with the lines of pixel driving circuits and on the average image load. The average image load indicates the total current consumed by the display. Usually, due to a limited power supply capacity, this total current is limited to a lower value than the maximum current which would occur if all the LED's generate light. Therefore, if the data is such that the total current would become higher than the maximum current the power supply is able to supply, the peak brightness is lowered. For example, the peak brightness is controlled by adapting the data in dependence on the expected average load to lower the light output during a frame such that the average load is limited. If, however, the average image load is relatively low, a high peak brightness is allowed because the total current will not be near the maximum current the power supply can handle. Then, the current in LED's which generate light is relatively high and thus the voltage drop across the power supply electrodes will be relatively high. Thus, as defined in the embodiment in accordance with the invention as claimed in claim 10, the level of the power supply voltage has to be increased when the average load decreases. Or said differently, for a high average load, the power supply voltage can be lowered and the power consumption of the active matrix display decreases further.

In an embodiment as claimed in claim 11, the power supply electrodes extend both in the direction of the select electrodes and in the direction of the data electrodes. At the intersections of the power supply electrodes extending in the direction of the select electrodes and the power supply electrodes extending in the direction of the data electrodes a conductive connection exists to form a conductive grid. In such a grid, the voltage drops will become smaller. Still, it is possible to determine the load in the power supply electrodes in the direction of select electrodes or in the direction of the data electrodes as discussed hereinbefore. If the load is determined in the direction of the data electrodes this means that the load depends on the actual state of the LED's associated with a data electrode. Again, the power supply may be controlled with this load. Again, the load may be determined as the highest one of the loads determined for the power supply electrodes separately, and the power supply is controlled by this highest load. However as is defined in the embodiment in accordance with the invention as claimed in claim 12, if the power supply electrodes form a grid it may be sufficient to control the power supply depending on the average image load only.

These and other aspects of the invention are apparent from and will be elucidated with reference to the embodiments described hereinafter.

DETAILED DESCRIPTION OF THE PREFERRED EMBODIMENT

Figure 1:
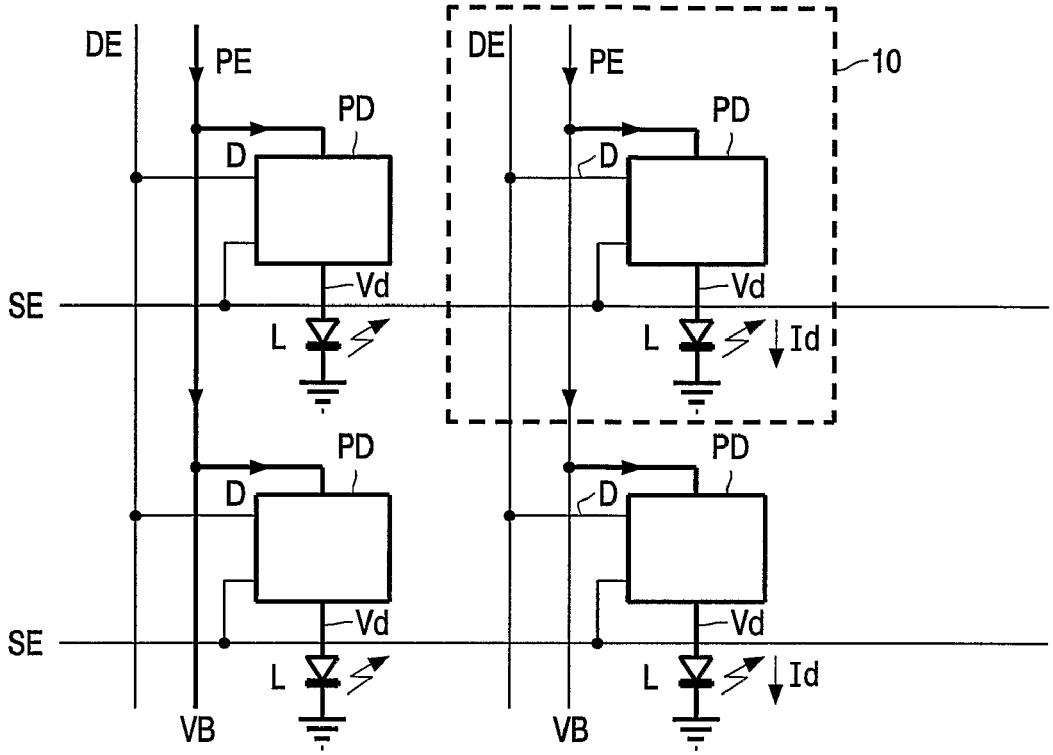
FIG. 1 shows a detailed view of part of a matrix display device.

FIG. 1 shows a detailed view of part of the matrix display device. Only four pixels 10 are shown. In a practical implementation, the matrix display device may have many more pixels 10. Each pixel 10 comprises a LED L and a pixel driving circuit PD. The LED may be, for example, an inorganic electroluminescence (EL) device, an organic EL device, a cold cathode, or an organic LED like a polymer or small molecule LED. Especially, polymer and Small Molecule OLED's have opened a new path to make high quality displays. The advantages of these displays are the self-emissive technology, a high brightness, a near-perfect viewing angle and a fast response time. These advantages indicate that the OLED technology holds the promise of providing a better front of screen performance than LCD displays. It is possible to use passive matrix and active matrix addressing. For relatively large displays (>10"), which are considered in the now following, active matrix addressing is required to reduce the power consumption.

By way of example, in FIG. 1 the select electrodes SE extend in the row direction and the data electrodes DE extend in the column direction. It is also possible that the select electrodes SE extend in the column direction and that the data electrodes DE extend in the row direction. Again, by way of example, the power supply electrodes PE extend in the column direction. The power supply electrodes PE may as well extend in the row direction, or may form a grid.

Each pixel driving circuit PD receives a select signal from its associated select electrode SE, a data signal D from its associated data electrode DE, a power supply voltage VB from its associated power supply electrode PE, and supplies a voltage Vd and a current Id to its associated LED L. Although for each pixel the same references are used to indicate the same elements, the value of signals, voltages and data may be different.

The current Id is driven through the LED L via the pixel driving circuit PD and the power supply electrode PE. The grey level of the LED is determined by the level of the current that is flowing through the LED. The current Id is determined by the data signal level on the data electrode DE. The select electrodes (also commonly referred to as address lines) SE are used to select (or address) the rows of pixels 10 one by one. In practice, more address lines per display line may be used, for example to control the duty cycle of the current Id supplied to the LED's L. It is possible to select more than one row of pixels 10 at a time.

The power supply electrodes PE supply the current required to generate the required amount of light in the LED's L. A voltage drop occurs across the power supply electrode PE due to its resistance. This voltage drop may result in cross-talk. The voltage on each pixel 10 of the display should at least be equal to the sum of the voltage required by the pixel driving circuit PD to operate correctly and the voltage Vd required across the LED to be able to generate the required amount of light. The effect of the resistance of the power supply electrode PE will be elucidated with respect to FIG. 6. An example of a pixel driving circuit PD is elucidated with respect to FIG. 7.

Figure 2:
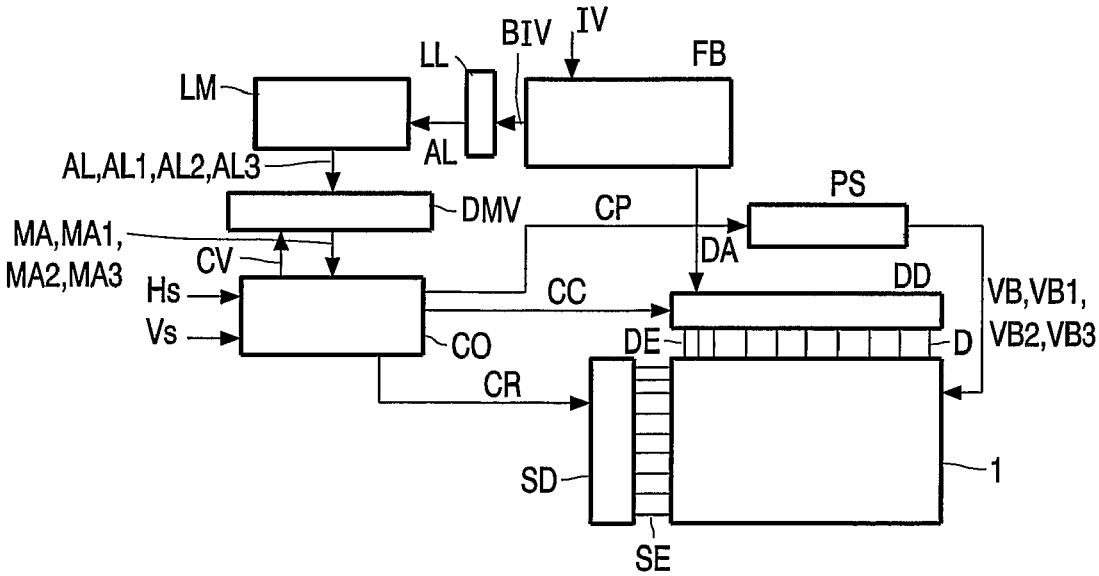
FIG. 2 shows a block diagram of an active matrix display system in accordance with the invention.

FIG. 2 shows a block diagram of an active matrix display in accordance with the invention. The active matrix display comprises an active matrix display device 1 which comprises the pixels 10 (see FIG. 1) associated with intersecting select electrodes SE and data electrodes DE. The select driver SD supplies the select voltages or select data to the select electrodes SE to select the select electrodes SE one by one. This means that the pixels 10 associated with the selected select electrode SE will produce an amount of light determined by the data D supplied by the data driver DD to the data electrodes DE. When a next select electrode SE is selected, the state of the pixels 10 associated with the previously selected select electrode SE is kept. Again the state of the pixels 10 associated with the now selected select electrode SE is determined by the data D on the data electrodes DE. All the select electrodes SE have been selected once after a frame period and a complete image is displayed. The next image will be displayed during the next frame period. The power supply PS supplies the power supply voltage VB to the power supply electrodes PE (see FIG. 1) of display device 1.

In order to display each image correctly, the worst case value of the voltage drop across the power supply electrodes PE must be determined. When using power supply electrodes extending in the column direction, the largest voltage drop will occur in the display column which emits the largest amount of light, thus in the column of pixels 10 with the largest video load. Therefore, it is determined which column has the largest video load. In this column, the largest current flows through the power supply electrode PE. Then, the value of the power supply voltage VB which is required to ensure correct operation of the pixel driving circuits PD is determined for this column. Since this is a worst-case value, the calculated value can be applied to the entire display and all pixel drive circuits PD operate correctly. A pixel drive circuit PD operates correctly if the power supply voltage VB is sufficiently high to enable the pixel drive circuit PD to supply the voltage Vd to the LED L.

A possible method to implement the proposed algorithm is now discussed. First the input video IV is stored in a frame buffer FB as the buffered input video BIV. A line load calculator LL receives the buffered input video BIV to calculate the column load AL for each column of the display 1 and stores the calculated column load AL in a line memory LM. The column load AL of a particular column of pixels 10 may be determined by summing the grey values displayed by the LED's L of the particular column. After the entire image is analyzed, and all the column loads AL are determined, the maximum value detector DMV detects the highest value MA of the column loads AL. The controller CO receives this highest value, the line synchronization signal Hs and the frame synchronization signal Vs of the input video IV and supplies a control signal CP to the power supply PS to set the power supply voltage VB to a particular level suitable for the highest value MA of the column loads AL. Preferably, the controller CO uses a pre-defined table providing the suitable power supply voltage for different column loads AL. A suitable level of the power supply voltage VB is a level which is high enough to enable the pixel driving circuits PD to operate correctly. But, if the column load AL is not the maximum load occurring when all LED's associated with the column have to receive their maximum current, this suitable level is lower than the maximum level required for the maximum load such that the power consumption is decreased. The line memory LM is not essential, the highest value MA may also be found by comparing the present calculated column load AL with the stored highest column load AL found so far. If the present calculated column load AL is higher than the stored column load AL the present column load AL is stored.

It is not essential that the same power supply voltage VB is supplied to all power supply electrodes PE of the display. As elucidated in more detail with respect to FIG. 4, the power supply electrodes may be divided in groups each receiving their own power supply voltage VB1, VB2, VB3. Now, the highest value MA1, MA2, MA3 of the column load is determined per group. These highest values MA1, MA2, MA3 can be determined from the column loads AL which are stored in the line memory LL. Thus, in the line memory LL, the column load AL is available for each column. Now the control signal CP is able to control the level of the plurality of power supply voltages VB1, VB2, VB3 generated by the power supply PS. A possible grouping method is to gather all columns of the same subpixel color (red, green or blue) in the same group. With a red, green and blue group, the voltages VB1, VB2 and VB3 can be optimized for the three different colors, which, usually, have different efficiencies. The different voltage drops for subpixels of different colors can be taken into account optimally.

It is not essential that the maximum value is determined. It is also possible that each power supply electrode PE has its own power supply voltage VB of which the level is controlled by the power load AL determined for this column. It is also possible to control the level of the power supply voltage(s) VB with an average value of the load AL. This average value is preferable determined for all the pixels 10 of the complete display 1 or for a group of interconnected power supply electrodes PE. Especially when the power supply electrodes PE form a grid, it is sufficient to only control the level of the power supply voltage VB dependent on the average value of the load AL as is elucidated in more detail with respect to FIG. 5.

If the power supply electrodes PE extend in the row direction, the voltage drop across these electrodes will be maximal in the display row with the largest line load AL. Note that in this case, the above-described principle is also valid, instead of a column load AL now a line load AL has to be calculated for each line.

The controller CO further supplies a control signal CR to the select driver SD and a control signal CC to the data driver DD to synchronize the selection of the rows of pixels 10 and the supply of data D to the selected row of pixels 10. The controller CO supplies a control signal CV to the maximum value detector DMV to control the determination of the maximum value MA.

Figure 3:
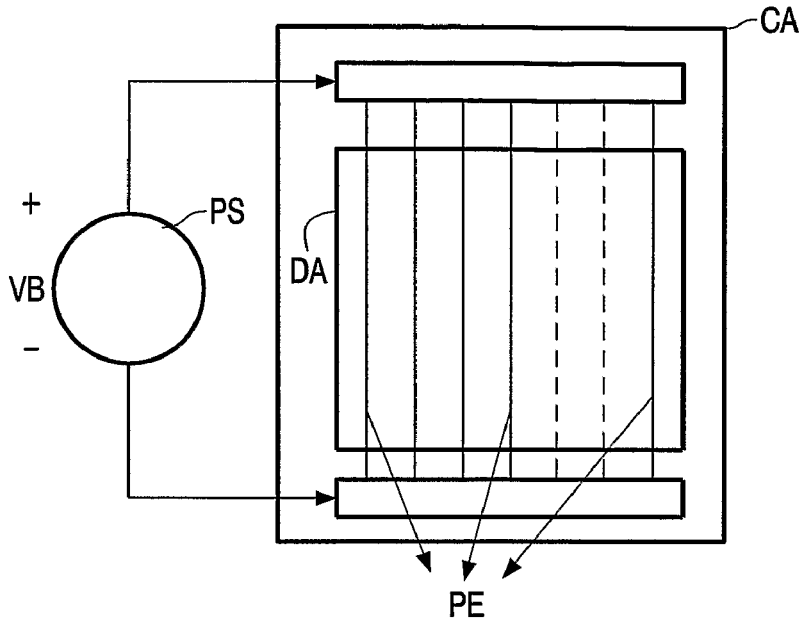
FIG. 3 shows a stylistic view of the matrix display device and its power supply electrodes which are all interconnected and which extend in the column direction.

FIG. 3 shows a stylistic view of the matrix display device and its power supply electrodes which are all interconnected and which extend in the column direction. The area CA represents the carrier for the active display area DA. The power supply electrodes PE extend in the column direction and are all interconnected to receive the same power supply voltage VB from the power supply PS.

Figure 4:
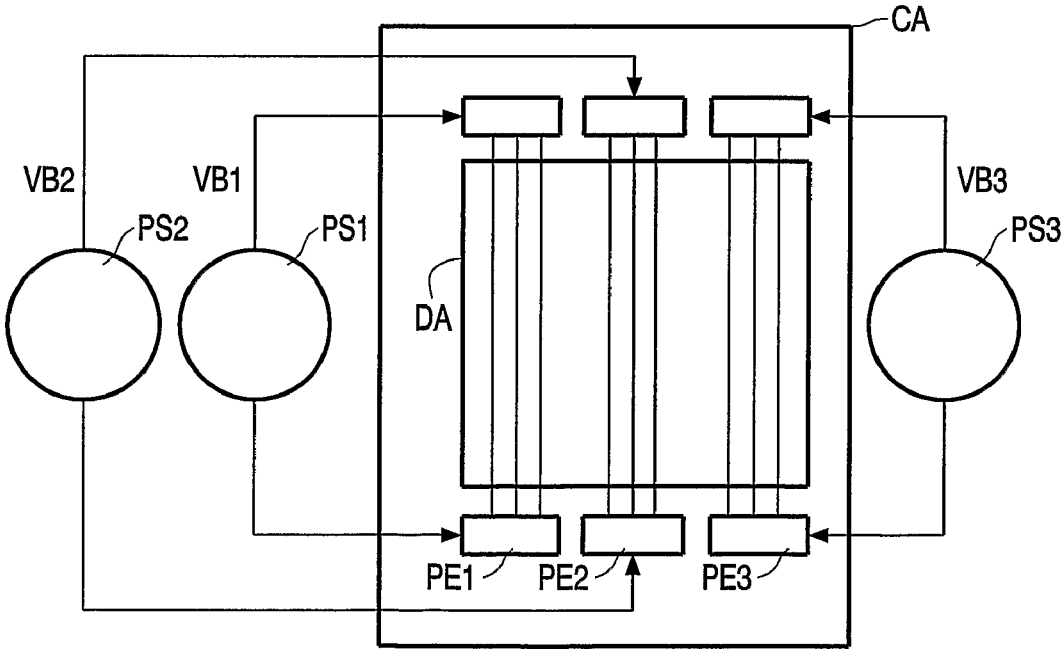
FIG. 4 shows a stylistic view of the matrix display device and its power supply electrodes which are interconnected in groups and which extend in the column direction.

FIG. 4 shows a stylistic view of the matrix display device and its power supply electrodes which are interconnected in groups and which extend in the column direction. In this example, three groups of interconnected power supply electrodes PE1, PE2, PE3 are shown which receive the power supply voltages VB1, VB2, VB3, respectively, from the power supplies PS1, PS2, PS3, respectively. It is possible to divide the power supply electrodes PE in less or more groups of interconnected power supply electrodes PE. It is also possible to connect a separately controllable power supply voltage VB to each one of the power supply electrodes PE, separately.

Figure 5:
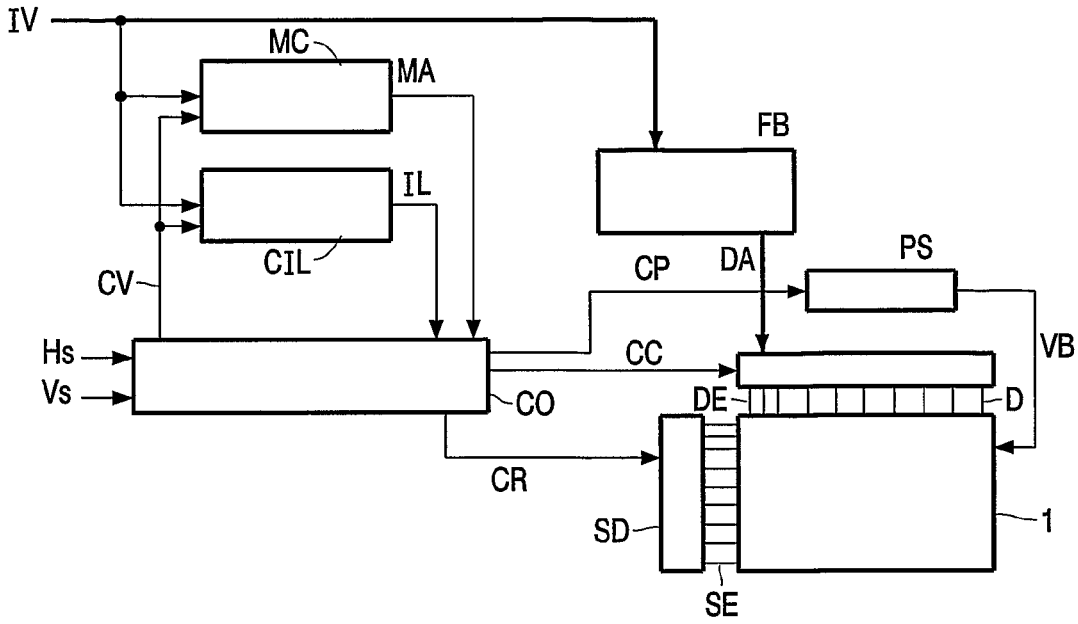
FIG. 5 shows a block diagram of an active matrix display system in accordance with the invention.

FIG. 5 shows a block diagram of an active matrix display in accordance with the invention. In order to limit the maximum power consumption of the display 1, a so-called power control algorithm is implemented. The power control algorithm varies the peak brightness of the display 1 dependent on the displayed image to obtain an average power consumption which is limited to a predetermined maximum power consumption. The power supply PS or the power supplies together are dimensioned to be able to supply this predetermined maximum power. To limit the power consumption, in images with a high content, the peak brightness is decreased, while in images with a low content the peak brightness is allowed to be high. With high and low content is meant a content which causes a high or low load on the power supply or power supplies PS, respectively. Thus, usually, a high content exists when a large part of the image has a high brightness.

All of these power control algorithms influence the voltage drop across the power supply electrode PE. For example, a possible method is to change the maximum data signal that is programmed in the pixel driving circuit PD via the data electrode DE (see FIG. 1). The grey level with the highest value will be programmed with a lower voltage which results in a lower current and thus a lower luminance. Consequently, the maximum voltage drop across the power supply electrodes PE decreases when the luminance of the display is scaled downwards to prevent a too large average load. Thus, the level of the voltage on the power supply electrodes PE can be made dependent on the setting of the power control algorithm. If the power control algorithm detects a high content, the brightness of the display is decreased, the voltage drop across the power supply electrodes PE decreases and thus the level of the power supply voltage(s) VB can be decreased to optimize the power consumption.

FIG. 5 shows a possible implementation of the control of the power supply voltage(s) VB dependent on the picture content detected. The items in FIG. 5 which have the same reference as in FIG. 2 have the same function and need not be elucidated again. The maximum value calculator MC comprises the line load calculator LL, the line memory LM, and the maximum value detector DMV. The major difference with respect to FIG. 2 is that a power load calculator CIL is added. This power load calculator CIL performs the power control algorithm by determining the overall image load which basically is the summed grey level of the image. The power load calculator CIL receives the input video IV, the control signal CV and supplies the overall image load IL to the controller CO. The controller CO uses the calculated overall image load IL to set the peak brightness of the display 1. For example, the controller CO controls the data driver DD to change the maximum signal level programmed in the pixel driving circuits PD. Alternatively, the controller may control the data driver DD or a data processor (not shown) to alter the values of the data words received. In the embodiment in accordance with the invention shown in FIG. 5, the controller uses both the calculated overall image load IL and the maximum value MA to set the level of the power supply voltage(s) VB.

Alternatively, it is possible to set the level of the power supply voltage(s) based on the overall image load IL only. This is especially possible if a power grid is implemented instead of power lines. With power lines is meant that the power supply electrodes PE extend either in the column or in the row direction. With power grid is meant that the power supply electrodes PE extend both in the column and the row direction and that the intersections of the power supply electrodes PE extending in the column direction and the power supply electrodes PE extending in the row direction provide are electrically interconnected. In the power grid, the current will be distributed over several power electrodes PE of different columns because the current can flow in four instead of two directions. For full white images the power supply voltage drop will not be different if the power grid is used instead of power lines. However, in images with a lower than maximum image load, the current will be spread over multiple power lines and columns, and consequently, the power supply voltage drop will be lower. This means that the power supply voltage(s) VB may be varied depending on the average image load IL of the entire image instead of a column. Note that in this approach, preferably, the brightness control of the power control loop is taken into account as elucidated earlier.

Figure 6:
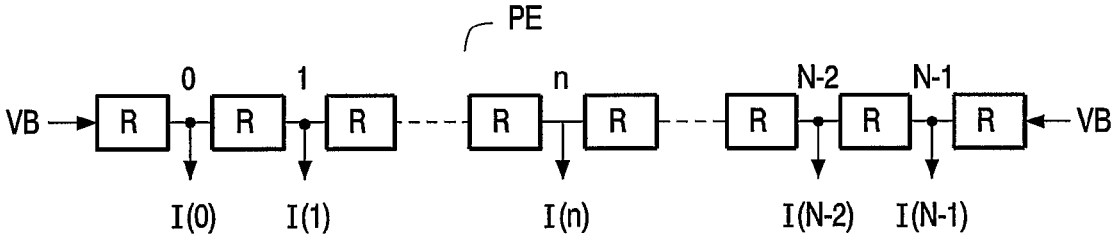
FIG. 6 shows a schematic representation of a power supply electrode.

FIG. 6 shows a schematic representation of a power supply electrode. The power supply electrode PE is assumed to comprise a series arrangement of lumped resistors R which represent the resistance of the power supply electrode PE between successive pixels 10. The first and last resistor represent the resistance of the power supply electrode PE from the first pixel to the power supply PS and from the last pixel to the power supply PS. This first and last resistor R may have a value different than the other resistors. The numbers i (ranging from 0 to N−1) above the junctions between two successive lumped resistors R indicate the number of the pixel 10 to which the associated current I(i) flows. The total number of pixels 10 along this power supply electrode PE is N. The power supply electrode PE shown may extend in the column direction or in the row direction.

The voltage drop along the power supply electrode PE is determined by the next equation.

$$Vn = V + R\left[\sum_{j=0}^{n}(n-j)I(j) - \frac{n+1}{N+1}\sum_{j=0}^{N-1}(N-j)I(j)\right] \quad \text{(equation 1)}$$

wherein n is the pixel number, N is the total number of pixels 10 associated with the power supply electrode PE, R is the resistance of the power supply electrode PE between two successive pixels, and I(j) is the current flowing into pixel j. This equation is valid if the power supply electrodes PE are arranged in lines. If the power supply electrodes PE are arranged in a grid, another equation is valid.

Figure 7:
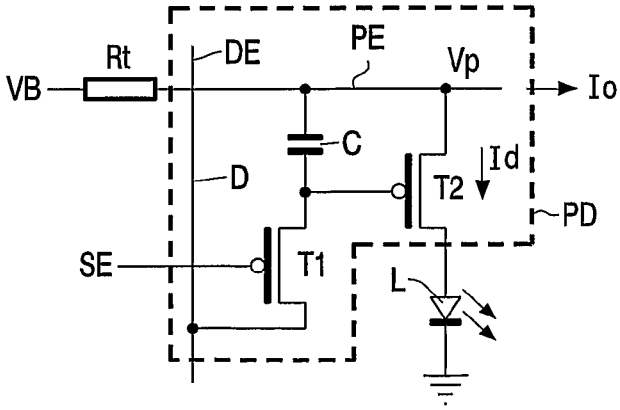
FIG. 7 shows an embodiment of a pixel driving circuit.

FIG. 7 shows an embodiment of a pixel driving circuit. The pixel driving circuit PD comprises a series arrangement of a main current path of a transistor T2 and the LED L. The transistor T2 is shown to be a FET but may be another transistor type, the LED L is depicted as a diode but may be another current driven light emitting element. The series arrangement is arranged between the power supply electrode PE and ground (either an absolute ground or a local ground, i.e. common voltage). The control electrode of the transistor T2 is connected to a junction of a capacitor C and a terminal of the main current path of the transistor T1. The other terminal of the main current path of the transistor T1 is connected to the data electrode DE, and the control electrode of the transistor T1 is connected to the select electrode SE. The transistor T1 is shown to be a FET but may be another transistor type. The still free end of the capacitor C is connected to the power supply electrode PE.

The operation of the circuit is elucidated in the now following. When a row of pixels is selected by an appropriate voltage on the select electrode SE with which this row of pixels is associated, the transistor T1 is conductive. The data signal D which has a level indicating the required light output of the LED L is fed to the control electrode of the transistor T2. The transistor T2 gets an impedance in accordance with the data level, and the desired current Id will start to flow through the LED L. After the select period of the row of pixels, the voltage on the select electrode SE is changed such that the transistor T1 becomes a high resistance. The data voltage D which is stored on the capacitor C drives the transistor T2 to still obtain the desired current Id through the LED L. The current Id will change when the select electrode SE is selected again and the data voltage D is changed.

The current Id has to be supplied by the power supply electrode PE which receives the power supply voltage VB via a resistor Rt. The resistor Rt represents the resistance of the power supply electrode towards the pixel 10 shown. It has to be noted that other pixels 10 associated with the same power supply electrode PE may carry current too, this current is denoted by Io. Both the currents Id and Io flow through the resistor Rt and thus cause a voltage drop in the power supply electrode PE. The pixel driving circuit PD will only function correctly if the voltage Vp across the series arrangement of the main current path of the transistor T2 and the LED L is sufficiently high to obtain the current Id. The current Id determines the brightness of the LED L indicated by the data D. The power supply voltage VB should at least have a value sufficient high to supply the pixel voltage Vp required by the pixel shown.

Usually, the level of the power supply voltage VB is selected to cover for the worst case situation. In the worst case situation, all the LED's L associated with the power supply electrode DE have to generate the maximum brightness. Thus the total current (I+Io) in the power supply electrode PE is maximal and also the voltage drop will be maximal. However, dependent on the brightness of the LED's L which are associated with the power supply electrode PE, it may well suffice to select a lower level of the power supply voltage VB.

In accordance with the present invention, the load on the power supply electrode PE is determined and the level of the power supply voltage VB is controlled dependent on this load. Many possibilities exist to determine this load in a power supply electrode PE or in a group of interconnected power supply electrodes PE. A relatively simple approach is to calculate the load from the input video IV, for example by summing the digital values indicating the brightness of the pixels 10 associated with the power supply electrode PE or with the group of power supply electrodes PE. The power supply voltage VB supplied to this power supply electrode PE, or to the group of interconnected power supply electrodes PE is controlled to fit the load determined. This fit may be determined in an operating display on beforehand and may be stored in a table. If a single power supply voltage VB is used for more than one power supply electrode PE, the load per power supply electrode PE may be calculated. The level of the power supply voltage VB is varied to fit the highest load calculated. This method of controlling the power supply voltage VB dependent on the load as determined from the input video IV, has the advantage that the power consumption decreases with respect to the known approach wherein the power supply voltage has constantly a high value to cater for the worst case situation which actually might not be present at all during the majority of its operating time.

It is possible to improve the power consumption decrease by more precisely determining the pixel 10 associated with a particular power supply electrode PE which requires the highest pixel voltage Vp. The input video IV indicates for each pixel the desired brightness of the LED L. Thus the desired current I(j) or Id at each node 1 to N−1 (see FIG. 6) can be calculated from the input video IV. The expected voltage Vp on each node 1 to N−1 is calculated using the equation 1. The behavior of the pixel driving circuit PD is known, for example, it is known what the voltage margin across the transistor T2 should be dependent on the current Id to be supplied. Consequently, it is possible to calculate what voltage Vp should be present on each pixel to be able to supply the desired current Id. The power supply voltage VB is controlled such that it has the minimal value required to allow the pixels receiving this power supply voltage VB to generate the desired currents I.

The decrease of the average power consumption by varying the power supply voltage VB in dependence on the calculated loads associated with the power electrodes PE is also relevant for other constructions of the pixel driving circuit PD, and applies for both voltage programmed pixel circuits as current programmed pixel circuits (where the data signal is respectively a voltage or current). For example, some alternative pixel driving circuits PD are disclosed in the publication "A Comparison of Pixel Circuits for Active Matrix Polymer/Organic LED Displays", D. Fish et al, SID 02 Digest, pages 968-971.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An active matrix display comprising a select driver (SD) for driving select electrodes (SE), a data driver (DD) for supplying data (D) to data electrodes (DE), a power supply (PS) for supplying a power supply voltage (VB), at least one power supply electrode (PE) for supplying the power supply voltage (VB) to pixel driving circuits (PD) of at least one line of pixels (10) extending in a same direction as the select electrodes (SE) and/or in a same direction as the data electrodes (DE), the pixels (10) being associated with intersections of the data electrodes (DE) and the select electrodes (SE), the pixels (10) comprising a light emitting element (L), and a pixel driving circuit (PD) for receiving the power supply voltage (VB) via the at least one power supply electrode (PE) and data (D) via the data electrodes (DE) to control a brightness of the light emitting element (L), means (LL) for determining a load (AL; MA; IL) on the at least one power supply electrode (PE), wherein the load (AL; MA; IL) is an image load indicating a ratio of the summed grey level of the pixels (10) associated with the at least one line of pixels (10) generating light and the maximum grey level of one of the pixels (10) multiplied by a total number of the pixels (10) associated with the at least one line of pixels (10), and means (CO) for controlling a level of the power supply voltage (VB) depending on the load (AL; MA; IL) determined.

2. An active matrix display as claimed in claim 1, wherein the means (CO) for controlling the level of the power supply voltage (VB) are arranged for increasing the level of the power supply voltage (VB) if a level of the load (AL; MA; IL) increases.

3. An active matrix display as claimed in claim 1, wherein the at least one power supply electrode (PE) comprises a plurality of power supply electrodes (PE) extending in the direction of the data electrodes (DE), the power supply voltage (VB) being supplied to all power supply electrodes (PE), and the means (LL) for determining the load (AL; MA; IL) comprises means (LL) for determining actual loads (AL), one for each one of the power supply electrodes (PE), and means (DMV) for determining the highest one of the actual loads (MA), and wherein the means (CO) for controlling is arranged for controlling the power supply voltage (VB) to a level accommodating the highest one of the actual loads (MA).

4. An active matrix display as claimed in claim 1, wherein the at least one power supply electrode (PE) comprises a plurality of power supply electrodes (PE) extending in the direction of the select electrodes (SE), the power supply voltage (VB) being supplied to all power supply electrodes (PE), and the means (LL) for determining the load comprises means (LL) for determining actual loads (AL), one for each one of the power supply electrodes (PE), and means (DMV) for determining the highest one of the actual loads (MA), and wherein the means (CO) for controlling is arranged for controlling the power supply voltage (VB) to a level accommodating the highest one of the actual loads (MA).

5. An active matrix display as claimed in claim 1, wherein the power supply (PS) is arranged for supplying a plurality of power supply voltages (VB1, VB2, VB3) to an associated plurality of groups of the at least one power supply electrode (PE1, PE2, PE3), the means for determining (LL) the load (AL) comprises:

means (LL) for determining the load (AL1, AL2, AL3) on each one of the plurality groups of the at least one power supply electrode (PE1 PE2, PE3), and the means (CO) for controlling being arranged for controlling a level of each one of the power supply voltages (VB1, VB2, VB3) in dependence on the associated load (AL1, AL2, AL3).

6. An active matrix display as claimed in claim 5, wherein the pixels having a same subpixel color are gathered in an associated one of the plurality of groups.

7. An active matrix display as claimed in claim 5, wherein the means for determining (LL) the load (AL) comprises means (LL) for determining, for at least one of the groups (PE1, PE2, PE3), actual loads (AL1, AL2, AL3), one on each one of the power supply electrodes (PE) of said at least one of the groups (PE1, PE2, PE3), means (DMV) for determining the highest one of the actual loads (MA1, MA2, MA3) determined within the at least one of the groups (PE1, PE2, PE3), and wherein the means for controlling (CO) is arranged for controlling the power supply voltage (VB1, VB2, VB3) associated with said at least one of the groups (PE1, PE2, PE3) to a level accommodating the highest one of the actual loads (MA1, MA2, MA3) determined within said at least one of the groups (PE1, PE2, PE3).

8. An active matrix display as claimed in claim 1, wherein the means (LL) for determining the load (AL) comprises means (CIL) for determining an average image load (IL) being determined by all the pixels (10) of the active matrix display, and wherein the means (CO) for controlling is arranged for controlling the level of the power supply voltage (VB, VB1, VB2, VB3) depending on the first mentioned load (AL; AL1, LA1, A2, LA2, AL3, LA3) and on the average image load (IL).

9. An active matrix display as claimed in claim 8, wherein the means (CO) for controlling is arranged for increasing the level of the power supply voltage (VB, VB1, VB2, VB3) when the average image load (IL) decreases.

10. An active matrix display as claimed in claim 1, wherein the at least one power supply electrode (PE) comprises a plurality of power supply electrodes extending both in the direction of the select electrodes (SE) and in the direction of the data electrodes (DE) for forming a conductive grid.

11. An active matrix display as claimed in claim 10, wherein the means (LL) for determining the load (AL) comprises means (CIL) for determining an average image load (IL) determined by all the pixels (10) of the active matrix display, and wherein the means (CO) for controlling are arranged for controlling the level of the power supply voltage (VB) depending on the average image load (IL).

12. A controller for an active matrix display comprising a select driver (SD) for driving select electrodes (SE), a data driver (DD) for supplying data (D) to data electrodes (DE), at least one power supply electrode (PE) being arranged for supplying a power supply voltage (VB) to pixel driving circuits (PD) of at least one line of pixels (10) extending in a same direction as the select electrodes (SE) or in a same direction as the data electrodes (DE), the pixels (10) being associated with intersections of the data electrodes (DE) and the select electrodes (SE), and comprising a light emitting element (L) and a pixel driving circuit (PD) for receiving the power supply voltage (VB) via the at least one power supply electrode (PE), and data (D) via the data electrodes (DE) to control a brightness of the light emitting element (L), means (LL) for determining a load (AL; MA; IL) on the at least one power supply electrode (PE), wherein the load (AL; MA; IL) is an image load indicating a ratio of the summed grey level of the pixels (10) associated with the at least one line of pixels (10) generating light and the maximum grey level of one of the pixels (10) multiplied by a total number of the pixels (10) associated with the at least one line of pixels (10), and means (CO) for controlling a level of the power supply voltage (VB) depending on the load (AL; MA; IL) determined.

13. A method of controlling an active matrix display comprising a select driver (SD) for driving select electrodes (SE), a data driver (DD) for supplying data (D) to data electrodes (DE), a power supply (PS) for supplying a power supply voltage (VB), at least one power supply electrode (PE) being arranged for supplying the power supply voltage (VB) to pixel driving circuits (PD) of at least one line of pixels (10) extending in a same direction as the select electrodes (SE) or in a same direction as the data electrodes (DE), the pixels (10) being associated with intersections of the data electrodes (DE) and the select electrodes (SE), and comprising a light emitting element (L) and a pixel driving circuit (PD) for receiving the power supply voltage (VB) via the at least one power supply electrode (PE), and data (D) via the data electrodes (DE) to control a brightness of the light emitting element (L), determining (LL) a load (AL; MA; IL) on the at least one power supply electrode (PE), wherein the load (AL; MA; IL) is an image load indicating a ratio of the summed grey level of the pixels (10) associated with the at least one line of pixels (10) generating light and the maximum grey level of one of the pixels (10) multiplied by a total number of the pixels (10) associated with the at least one line of pixels (10), and controlling (CO) a level of the power supply voltage (VB) depending on the load (AL; MA; IL) determined.

* * * * *